US008622876B2

(12) United States Patent
Kelliher

(10) Patent No.: US 8,622,876 B2
(45) Date of Patent: Jan. 7, 2014

(54) ROWING SIMULATOR

(75) Inventor: Richard J. Kelliher, Underhill, VT (US)

(73) Assignee: Rowing Innovations Inc., Williston, VT (US)

( * ) Notice: Subject to any disclaimer, the term of this patent is extended or adjusted under 35 U.S.C. 154(b) by 322 days.

(21) Appl. No.: 13/073,099

(22) Filed: Mar. 28, 2011

(65) Prior Publication Data

US 2011/0245044 A1 Oct. 6, 2011

Related U.S. Application Data

(60) Provisional application No. 61/320,147, filed on Apr. 1, 2010.

(51) Int. Cl.
*A63B 21/00* (2006.01)

(52) U.S. Cl.
USPC ..... 482/72; 482/73; 482/51

(58) Field of Classification Search
None
See application file for complete search history.

(56) References Cited

U.S. PATENT DOCUMENTS 203,973 A * 5/1878 Wilcox ..... 482/72
304,142 A * 8/1884 Spelman ..... 482/72
1,727,657 A * 9/1929 Martin ..... 482/72
2,912,264 A * 11/1959 Peck ..... 384/477
4,743,011 A 5/1988 Coffey
7,022,052 B1 * 4/2006 Lai ..... 482/72
8,109,859 B2 * 2/2012 Medina ..... 482/8
2008/0280736 A1 * 11/2008 D'Eredita ..... 482/72

FOREIGN PATENT DOCUMENTS

GB 2238001 5/1991

OTHER PUBLICATIONS

Examination Report dated Feb. 7, 2013, for related application GB1105358.4 filed Mar. 30, 2011 entitled "Rowing Innovations Inc.," Kelliher, Richard J.
International Search Report dated Jun. 27, 2011 for related application GB1105358.4 filed Mar. 30, 2011 entitled "Rowing Innovations Inc.," Kelliher, Richard J.

* cited by examiner

*Primary Examiner* — Jerome w Donnelly
(74) *Attorney, Agent, or Firm* — Downs Rachlin Martin PLLC

(57) ABSTRACT

Rowing simulators that include a variety of features that provide one or more rowers with a rowing experience that more accurately simulates on-water rowing and/or provide enhanced training feedback. One feature is a rowing station that includes one or two oars each having a vertical-feel emulator implemented as a compliant guide follower that engages a corresponding oar guide during the drive phase of the rowing stroke so as to simulate an oar's engagement with water during on-water rowing. In other embodiments, the vertical-feel emulator is incorporated into an oar support. Other features include: stroke gauges that provide visual feedback on the various phases of a rower's stroke, including the catch phase, drive phase, finish phase, and recovery phase; an oar feathering indicator; and seats linked together for training rowers to row in unison, among others.

36 Claims, 12 Drawing Sheets

ROWING SIMULATOR

RELATED APPLICATION DATA

This application claims the benefit of priority to U.S. Provisional Patent Application Ser. No. 61/320,147, filed on Apr. 1, 2010, and titled "Rowing Simulator And Methods Of Training A Rower," which is incorporated by reference herein in its entirety.

FIELD OF THE INVENTION

The present invention generally relates to the field of on-water rowing. In particular, the present invention is directed to a rowing simulator.

BACKGROUND

A variety of rowing machines exist for physical fitness of rowers and for fitness training in general. The three most influential rowing machines developed in the last 40 years are the Gamut Erg machine, the Gjessing Erg machine and the CONCEPT2® machine. The Gamut Erg and Gjessing Erg machines are no longer produced, but the CONCEPT2® machine is currently produced and has become the predominant rowing machine, especially for the physical conditioning of rowers of competitive rowing crews. Various competitors of the makers of the CONCEPT2® machine have incorporated numerous aspects of the CONCEPT2® machine into their machines. Other machines currently on the market include the Row Perfect, STAMINA®, Body Track, Life Care, KETTLER®, and Water Rower machines, among others.

SUMMARY

In one implementation, the present disclosure is directed to an apparatus designed and configured to train a rower on a rowing stroke that includes a catch phase, a drive phase, a finish phase, and a recovery phase. The apparatus includes: a first rowing station that includes: an oar support having an inboard side and an outboard side relative to the rower; an oar movably supported by the oar support and including: an inboard end located on the inboard side of the oar support; a handle located at the inboard end and being designed and configured to be grasped by the rower while rowing; an outboard end located on the outboard side of the oar support; and a guide follower designed and configured to contact an oar guide during the entirety of the drive phase of the rowing stroke so as to provide substantially no horizontal resistance to movement of the oar by the rower during the drive phase of the rowing stroke; and a resistance mechanism coupled to the oar and designed and configured to resist substantially horizontal movement of the oar by the rower during the drive phase of the rowing stroke.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

Figure 1:
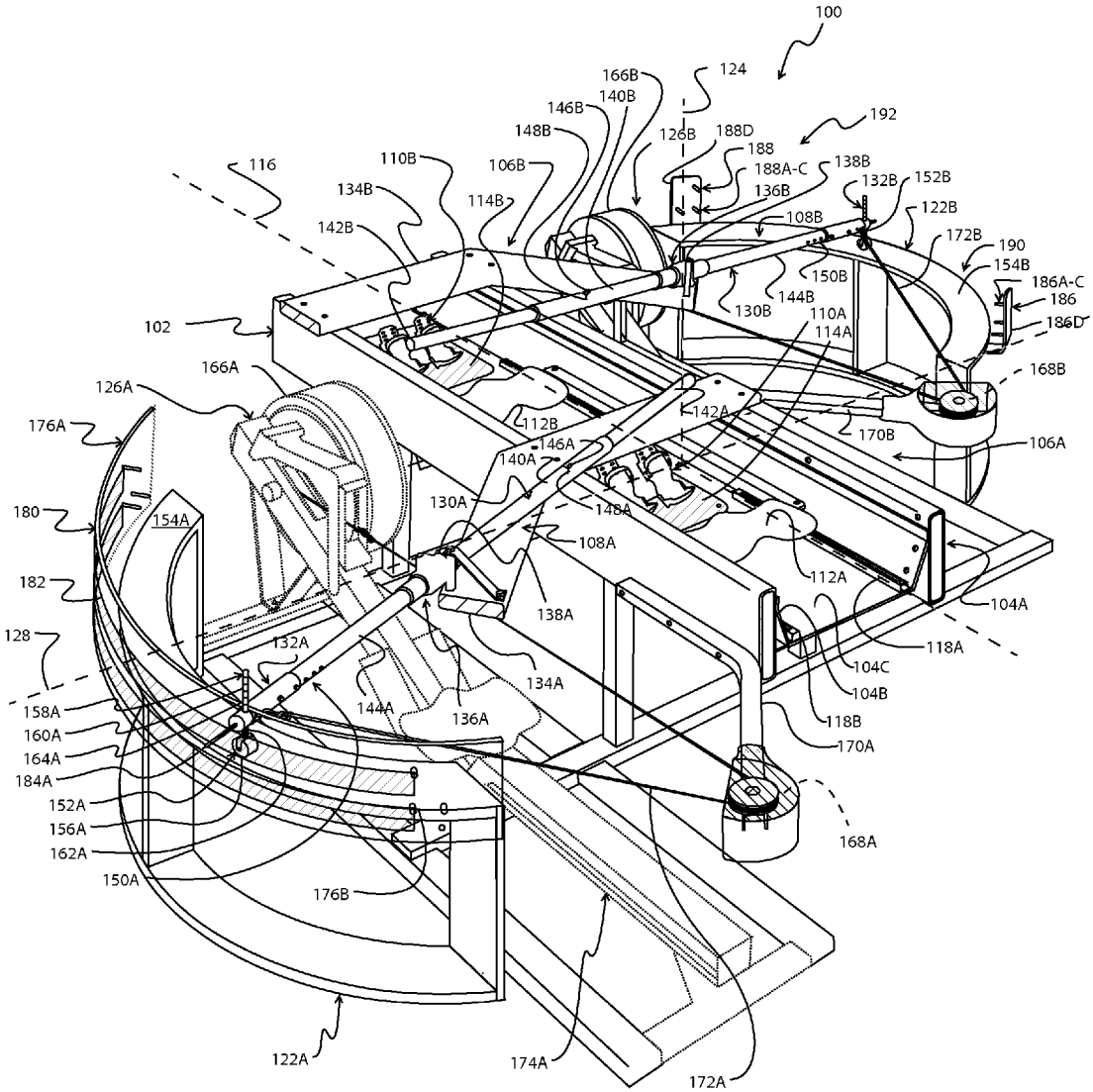
FIG. 1 is a perspective view of an exemplary rowing simulator that incorporates various features described in detail in the present disclosure.

Referring now to the drawings, FIG. 1 illustrates one example of a rowing simulator 100 made in accordance with the present disclosure. As will be understood from reading this entire disclosure, rowing simulator 100 includes a number of unique features that provide a number of advantages, including providing a rower with a realistic simulated rowing experience in a controlled environment, allowing a coach to assess rower performance during rowing, providing a rower with instantaneous feedback on various aspects of his/her rowing stroke, and being usable with existing rowing machines, among others. Details of the features that provide these and other advantages are described below in detail.

Before describing rowing simulator 100, it is noted that this disclosure uses the following standard nautical terminology to identify the locations of various parts of the simulator that correspond to parts on an actual boat, which the simulator is generally set up to simulate: "bow" refers to the leading, or front, end of the boat that points in the direction of travel during proper rowing; "stern" refers to the trailing, or rear, end of the boat that is opposite the bow; "starboard" refers to the right-hand side when aboard the boat and facing the bow; and "port" refers to the left-hand side when aboard the boat and facing the bow. This disclosure also uses the following rowing terminology: "sweep" refers to a rowing style in which each rower operates one oar with both hands; "sculling" refers to a rowing style in which each rower simultaneously operates two oars, one in each hand; "catch" is a maneuver in which the rower places an oar blade in the water; "finish" is a maneuver in which the rower removes the oar blade from the water; "feathering" is a maneuver in which the rower rotates the oar after extraction from the water so that each blade face of the oar is parallel to the water; "squaring"

is a maneuver in which the rower rotates the oar prior to the catch to pivot the faces of the oar blade from parallel to the water to perpendicular to the water; "drive" is a phase of the rowing stroke from the catch to the finish; and "recovery" is a phase of the stroke from the finish to the catch.

With these terms in mind, rowing simulator 100 has a shell structure 102, which in this embodiment is generally configured to mimic the shell of an actual rowing boat. Shell structure 102 includes a seating region 104 generally defined by starboard and port gunwales 104A-B and a seat deck 104C extends between the gunwales. While the term "shell structure" is used herein, it is noted that the physical structure need not form an actual shell, for example, the structure need not have continuous solid walls. For example, in some alternative embodiments shell structure 102 can be a minimalistic open structure, such as a ladder-type structure or a truss-like structure, that provides only the structural members necessary to allow simulator to function properly. In yet other embodiments, shell structure 102 can be fashioned from an actual rowing shell. Generally, the construction of shell structure 102 can be any construction suitable for the purposes of simulator 100.

Figure 12:
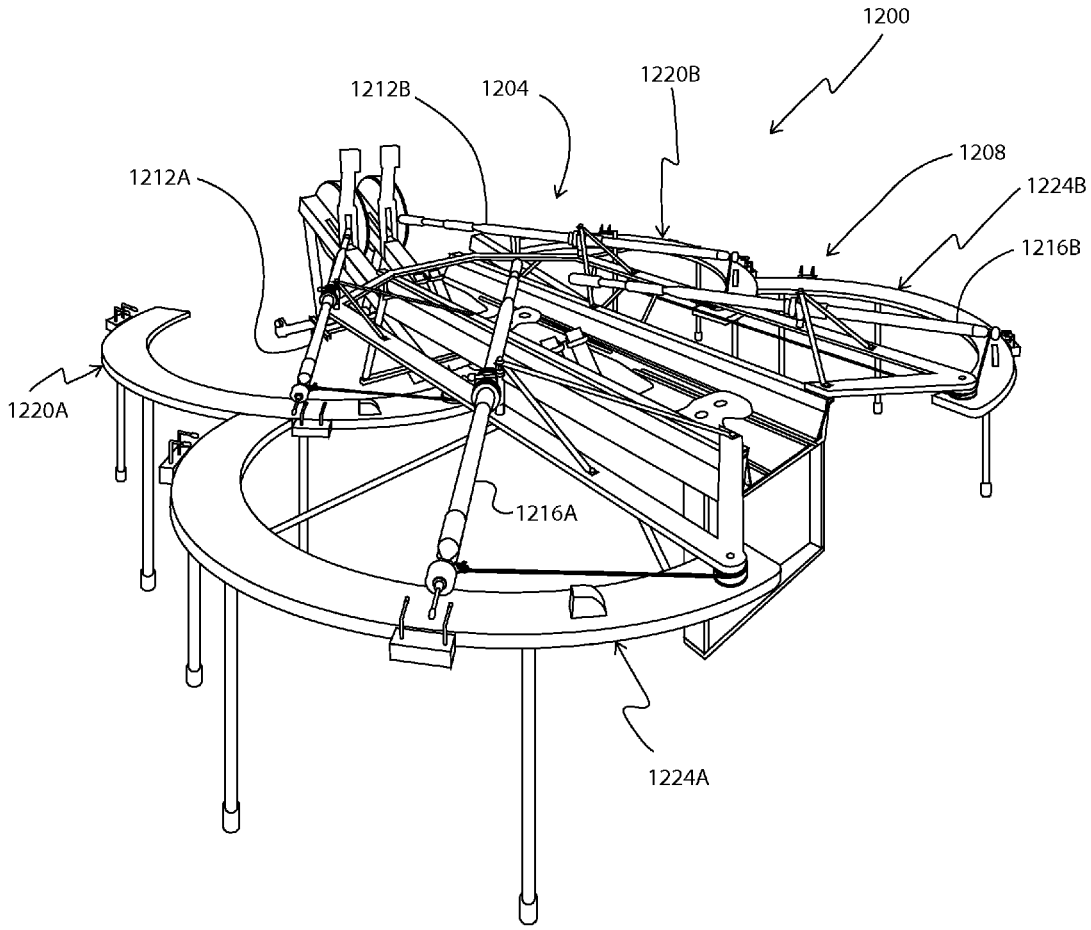
FIG. 12 is a perspective view of a rowing simulator embodying features disclosed herein and setup in a two-station sculling configuration.

In this example, rowing simulator 100 is set up as a two-person module having two sweep-type rowing stations, a starboard-oar rowing station 106A (here, the fore station) and a port-oar rowing station 106B (here, the aft station) having, respectively, a port-side oar assembly 108A and a starboard-side oar assembly 108B, which are described below in much more detail. As those skilled in the art can readily appreciate, alternative embodiments of a rowing simulator made in accordance with the present disclosure can be set up with one or more sculling-type rowing stations so as to provide each rower with port and starboard oars. An example of a rowing simulator 1200 configured for sculling training is shown in FIG. 12 and described below.

Each rowing station 106A-B has a pair 110A-B of foot stretchers and a seat 112A-B for accommodating a rower. In this example, foot stretcher pairs 110A-B are located in corresponding respective foot wells 114A-B. Each seat 112A-B is slidable within shell structure 102 in a direction parallel to Y-axis 116, in this example along a pair of seat tracks 118A-B secured to shell structure 102 on opposite sides of seat deck 104C. It is noted that seats 112A-B are configured to be slidable independently of one another, but, in this example the seats are removably tied together with optional seat ties 120A-B (FIG. 2) that enable the seats to move in unison. The use of seat ties 120A-B can be beneficial under certain training conditions. When seats 112A-B are tied together, each rower is subjected to the same fore and aft movements, which tend to force the rowers to act in unison with one another. Being forced to row in unison with one or more other rowers using a rowing simulator of the present disclosure, such as simulator 100, can greatly improve a rowers synchronicity during actual on-water rowing events where the seats are not tied together.

Rowing simulator 100 also includes, in this example, a pair of oar guides, here, water tables 122A-B, that interact with corresponding respective oar assemblies 108A-B in a manner that provides the rowers with a strikingly realistic simulation of the interaction of a rowing oar with water in a vertical direction during actual on-water rowing, i.e., in a direction parallel to Z-axis 124 in FIG. 1. To round-out the oar/water interaction experience, rowing simulator 100 also includes a pair of resistance systems 126A-B that are specially configured to provide rowers with a strikingly realistic simulation of the interaction of a rowing oar with water in a horizontal plane during actual on-water rowing, i.e., in a plane parallel to the plane defined by X-axis 128 and Y-axis 116. Various aspects of rowing simulator 100 that provide these realistic simulations are described below.

Figure 2:
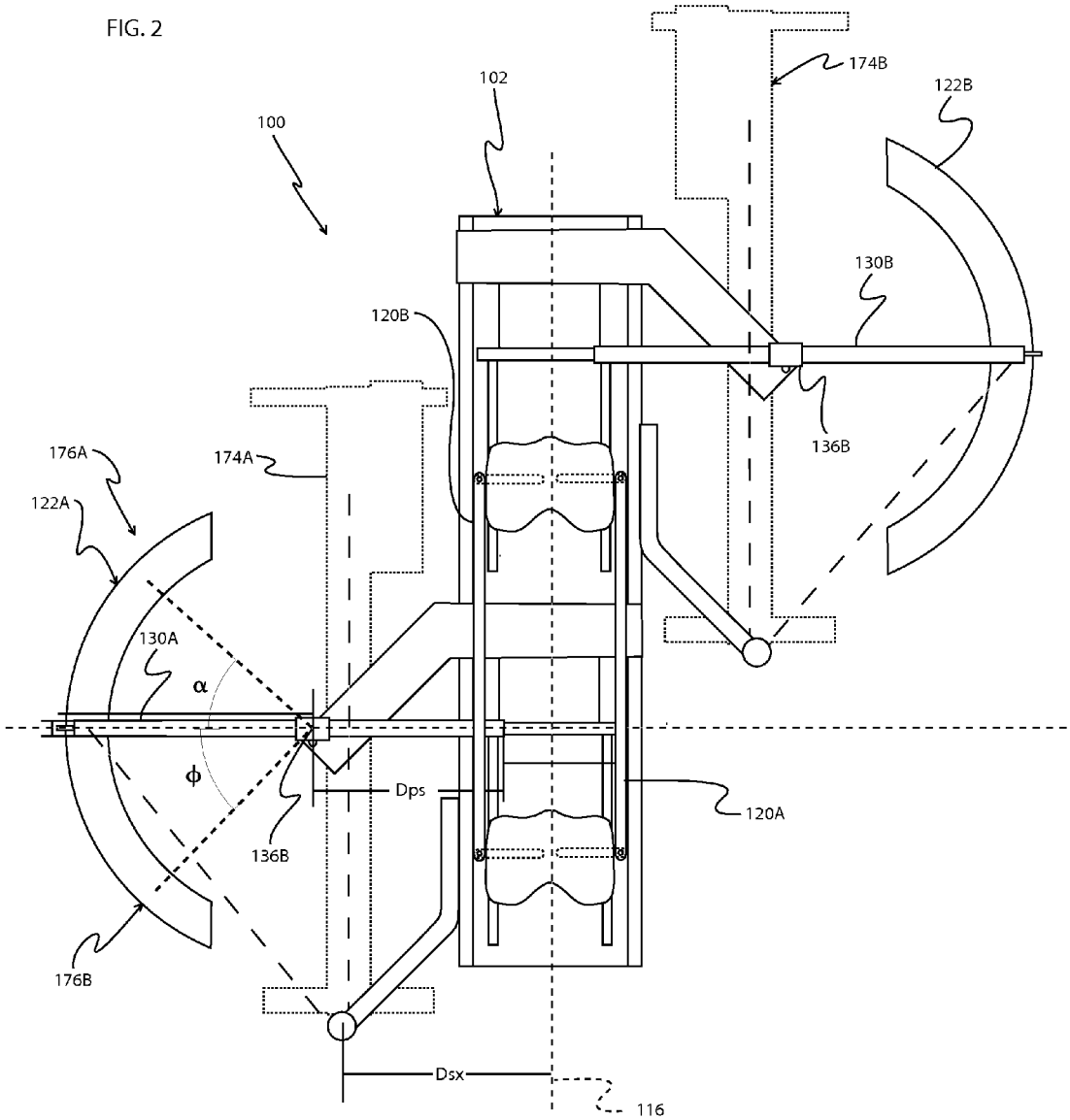
FIG. 2 is a top view of the rowing simulator of FIG. 1.
Figure 3:
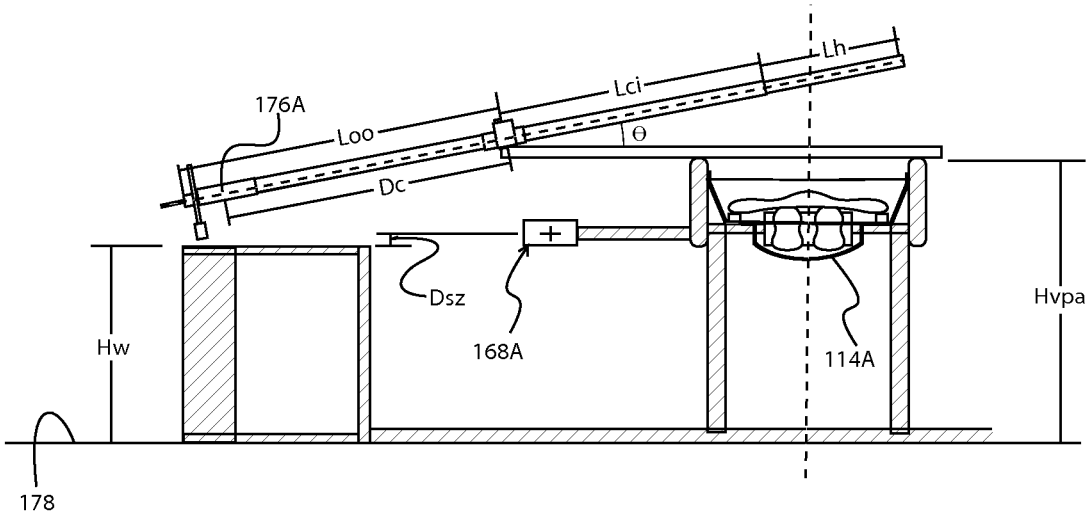
FIG. 3 is a reduced elevational view of the rowing simulator of FIG. 1 as viewed from the bow end of the simulator, showing the starboard rowing station and the starboard water table.

In the example shown in FIGS. 1-3, each oar assembly 108A-B includes a simulated oar 130A-B and a guide follower 132A-B located on the end of the oar distal from the corresponding rower. Each simulated oar 130A-B is attached to shell structure 102 via a corresponding outrigger 134A-B, which supports a corresponding oarlock 136A-B. Each oarlock 136A-B supports the respective oar 130A-B relative to the shell structure in a manner that permits the rower to move the oar horizontally, in this example about a corresponding rigger set pin 138A-B parallel to Z-axis 124, and vertically to perform a rowing stroke. Importantly, oarlocks 136A-B are located so as to mimic the locations of oarlocks on an actual rowing boat.

In this example, each oar 130A-B includes a central member 140A-B, a handle 142A-B, and an extension 144A-B. Each handle 142A-B is rotatably engaged with the corresponding central member 140A-B in a manner that provides rowing simulator 100 with feathering and squaring simulation. In the particular embodiment shown, central members 140A-B are cylindrical tubes, and each handle 142A-B is similarly cylindrical and extends into the corresponding one of the central members so as to be rotatable therein. In some embodiments, the magnitude of the force(s) needed to rotate each handle 142A-B relative to the respective central member 140A-B can be set to accurately simulate the force(s) needed to rotate an actual oar during feathering and squaring by presetting the rotational resistance of the handle within the central member. As a rower rotates the handle/shaft of an oar, the entire oar rotates, including the oar sleeve. This sleeve, which wraps around the shaft, is designed with two flat faces. As the sleeve is rotated, the appropriate face of the sleeve engages the flat face of the oar lock. There is a feeling and sound that corresponds to the positioning of the oar face into this correct position. As the rower rotates the oar from feathering to square they will feel and hear the transition. It is very clear to the rower when they are in the correct orientation for the recovery/feathering or drive/square position.

Each oar assembly 108A-B includes an oar-rotation indicator 146A-B that allows a rower and/or coach or other viewer to visually check the rotational position of the corresponding oar handle 142A-B during various stages of a rowing stroke, for example, to allow the rower to ensure that the handle is in the correct rotational position upon initially gripping the handle and to allow the rower/coach/viewer to assess the rower's feathering and squaring techniques during rowing. In this embodiment, each oar rotation indicator 146A-B is a peg that is fixedly secured to a corresponding one of handles 142A-B and extends through a corresponding circumferential slot 148A-B in tubular central members 140A-B. As the rowers rotate their respective oar handles 142A-B, indicators 146A-B move circumferentially in their corresponding respective slots 148A-B.

In the example shown in FIGS. 1-3, each water table 122A-B is configured in an arcuate shape selected based on the geometry of oar assemblies 108A-B such that the shape of the water table corresponds to the arc(s) swung by guide followers 132A-B of the corresponding respective oar assemblies during a rowing stroke. In the example shown, the length Loo from each set pin 138A-B to outboard tip of the corresponding oar 130A-B is adjustable by virtue of a pin-and-hole arrangement 150A-B that allows the respective guide follower 132A-B to be located at various distances from the corresponding set pin 138A-B. As will be described below in detail, this adjustability provides, among other things, the ability to adjust the water-related sensation and resistance each rower experiences not only in a vertical plane, but also in a horizontal plane. While water tables 122A-B are shown as having an arcuate shape, this need not be so. For example, in other embodiments each water table 122A-B can be another shape, such as rectangular, oval, etc. Generally, an important feature of the shape and size is that whatever oar guide is provided, it should have a guide surface sized and configured to accommodate the full arc of the rowing stroke in its interaction with the corresponding guide followers.

In this example, the sensations and resistances that rowers experience during rowing on water due to the water are simulated, in part, by the interaction of guide followers 132A-B with water tables 122A-B, which generally provides the rowers with sensation and resistance mimicking the interaction between an actual oar and water in a vertical plane, and by the resistance provided by resistance systems 126A-B, which generally provides the rowers with sensation and resistance mimicking the interaction between the actual water in a horizontal plane. Relative to the sensation and resistance in a vertical plane, each guide follower 132A-B includes an anti-friction element 152A-B that engages the corresponding upper surface 154A-B of the respective water table 122A-B, which may likewise be made of a suitable low-friction and/or hard material, depending on the nature of the anti-friction element.

In the example shown (see also FIG. 4), each antifriction element 152A-B includes a roller assembly 156A-B mounted on a strut 158A-B that extends through the corresponding guide follower 132A-B so that an upper portion 160A-B of that strut visibly extends from the upper side of that guide follower. A spring 162A-B, here a coil spring surrounding strut 158A-B, is biased between each roller assembly 156A-B and the corresponding guide follower 132A-B. Each spring 162A-B provides increasing vertical resistance to the corresponding rower as the rower lifts up on the corresponding handle 142A-B during the catch and drive phases of the stroke to simulate the sensation and resistance, or "vertical feel," that the rower would experience during actual rowing on water. In other words, each spring 126A-B in combination with the corresponding guide follower 132A-B provides rowing simulator 100 with a vertical feel emulator. Upper portions 160A-B of struts 158A-B can include markings or other indicia 164A-B that indicate the amount that corresponding respective springs 162A-B are compressed. The compression of springs 162A-B corresponds to the amount that an actual oar blade is submerged in water during actual rowing and also to the amount of force being applied by the rowers.

The rowers, or more typically a rowing coach or other viewer, can use indicia 164A-B to visually monitor the rowers' strokes, especially during the catch and drive phases. Example indicia suitable for indicia 164A-B include markings that correspond to the number of degrees of vertical rotation of oars 130A-B and/or markings indicating differing zones. Regarding the former, during the drive phase, a typical oar angle θ ranges from about 5° to about 10°, depending on the height of oarlocks 136A-B above corresponding respective water tables 122A-B, which is typically adjusted to match the height of a rower. Consequently, suitable indicia 164A-B can be degree markings in, say, 1° increments. Regarding the latter, the zones provided can be, for example, bands of differing colors that indicate that oar-blade insertion into the simulated water is too deep, too shallow, or within an acceptable band. In some embodiments, indicia 164A-B can be read based on the amount of extension of each upper portion 160A-B from the corresponding opening in the respective guide follower 132A-B. In other embodiments, a marker (not shown) can be fixedly mounted to each of guide followers 132A-B so that the marker is located above the upper surface of the guide follower and adjacent to a corresponding one of upper portions 160A-B of struts 158A-B.

Each resistance system 126A-B includes a resistance device 166A-B, a pulley 168A-B, here supported outboard of shell structure 102 by a corresponding bracket 170A-B, and a suitable longitudinally stiff, laterally flexible tensile member 172A-B, which may be, for example, a cord, cable, chain, etc. In this example, rowing simulator 100 is particularly configured to utilize the resistance mechanisms of a pair of CONCEPT2®, or similar, rowing machines 174A-B, available from Concept2, Inc., Morrisville, Vt. This configuration is particularly useful for organizations that already own and use such rowing machines as part of rowing training. Since each rowing machine 174A-B is a single-person machine, in this embodiment one rowing machine is provided for each rowing station 106A-B. Using existing rowing machines 174A-B is also beneficial because their resistance mechanisms, here, resistance devices 166A-B, are generally already configured to provide a suitable range of resistance to rowing simulator 100.

Figure 10:
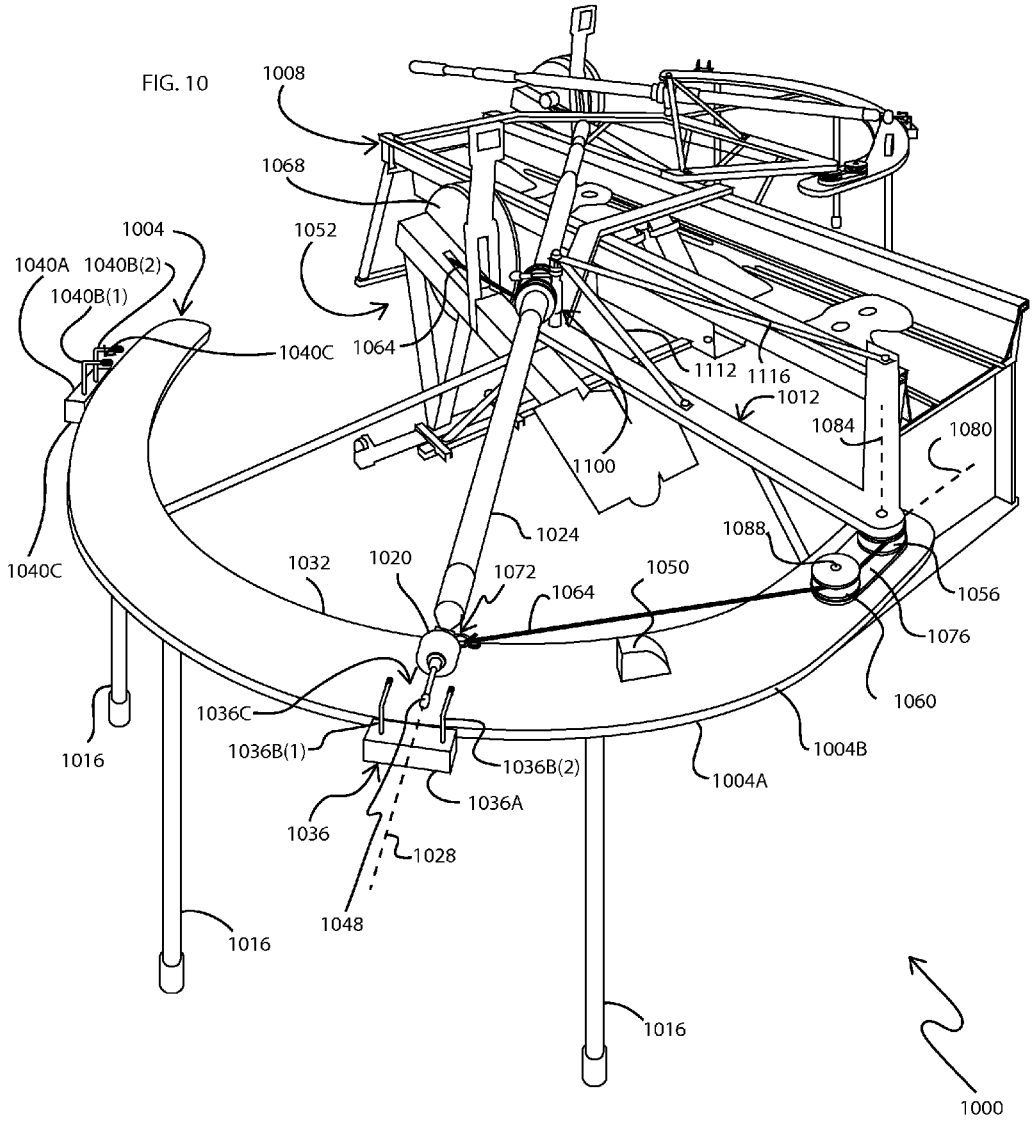
FIG. 10 is a perspective view of yet another rowing simulator having alternative implementations of various features of the rowing simulator of FIGS. 1-3.
Figure 13:
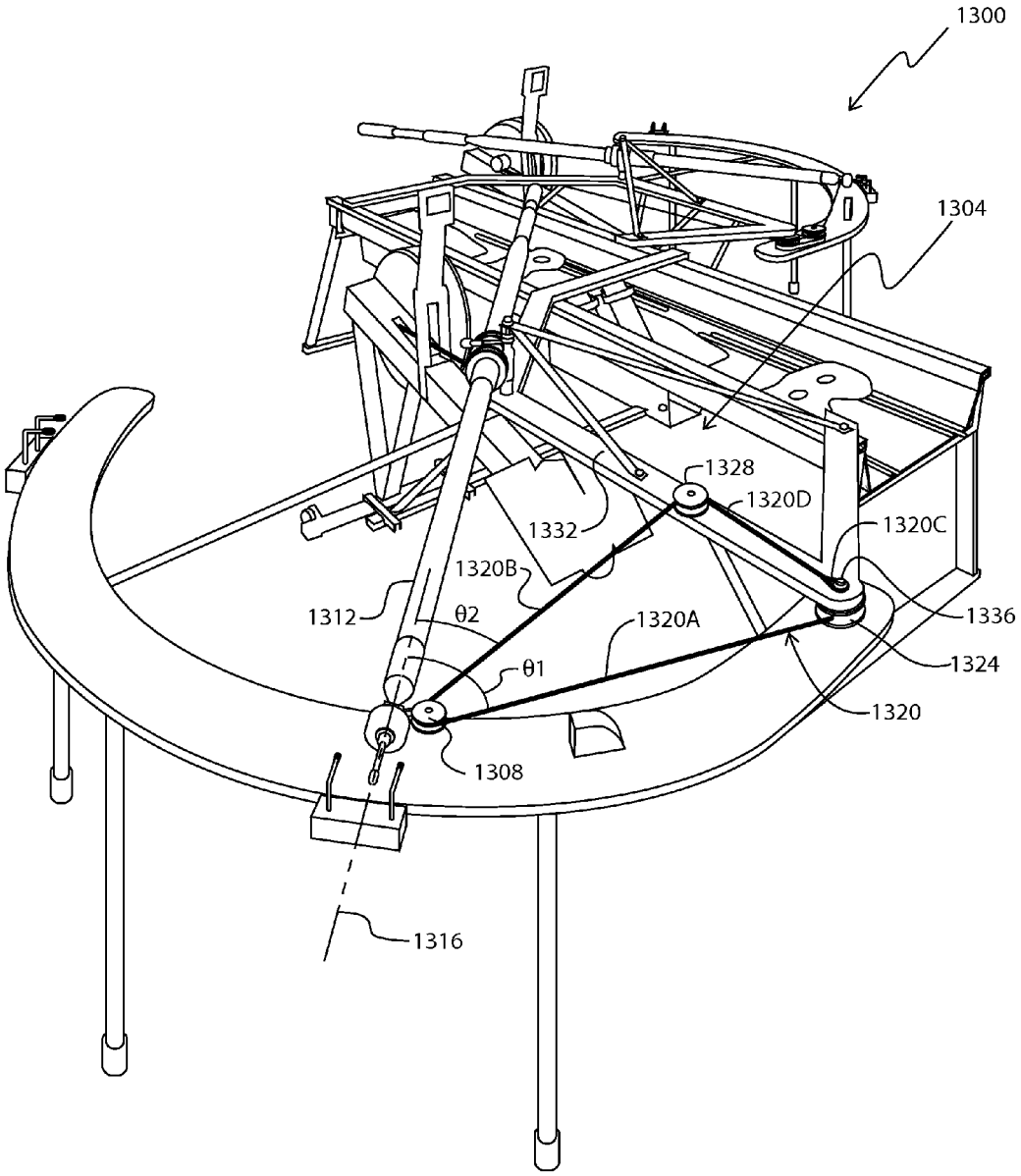
FIG. 13 is a perspective view of a rowing simulator that is similar to the rowing simulator of FIG. 10 but having a resistance system configured to provide each rower with a higher drive-stroke resistance using the same resistance mechanism as the simulator of FIG. 10.

That said, the present inventor has discovered that the forces experienced by rowers using the exemplary rowing simulator 100 of FIG. 1 requires each resistance system 126A-B to further include at least one strategically located pulley, in this example one pulley 168A-B with the corresponding resistance device 166A-B located aftward of the corresponding rowing station 106A-B as shown. In this case, each pulley 168A-B is particularly located via corresponding pulley brackets 170A-B to provide the proper geometry to the respective tensile member 172A-B relative to the location of the connection 176A-B of the tensile member with oar 130A-B, in this example on the corresponding guide follower 132A-B. This geometry provides each oar 130A-B with a variable resistance over the arc that the corresponding guide follower 132A-B traverses during the drive phase of the rowing stroke. In general, rowing simulator 100 mimics the feeling of power and acceleration that one feels with an oar in water. It matches the variable resistance felt during the various phases of a stroke. During the catch maneuver the rower feels the greatest resistance and during the release maneuver the rower feels the least resistance. So, in proper technique a rower will accelerate the oar during the stroke. As the boat moves through water, the rower accelerates the stroke speed. In a similar fashion, by placing the pulley in this specific location the invention is able to duplicate this variable resistance and allow the rower to naturally accelerate the oar speed through the stroke. Other embodiments of a resistance system that includes a resistance device similar to resistance device 166A-B and similarly located, and that use multiple pulleys are shown in FIGS. 10 and 13 and are described below.

FIG. 2 particularly illustrates the location of pulley 168A relative to oar 130A in a plane parallel to the plane of X- and Y-axes 128, 116, as well as the geometry of oar 130A itself and a typical rowing stroke in a similar plane. It is noted that the location of pulley 168B and the geometry of oar 130B and rowing stroke are similar to the corresponding items shown in FIG. 2. Those skilled in the art will readily appreciate that the dimensions given are suited to the precise configuration of rowing simulator 100 as shown in FIGS. 1-3, but may be different in other embodiments, depending on a number of variables, such as type of resistance devices 166A-B used, length of oar 130A-B implemented, and placement of oarlocks 136A-B, among others. Before describing various dimensions of a suitable setup of rowing simulator 100, it is noted that oar 130A is shown in its mid-drive position in which a vertical plane extending along the longitudinal axis of the oar is parallel to X-axis 128. Also illustrated in dashed lines are the location 176A of the longitudinal axis of oar 130A at the finish of the drive phase and the location 176B of the longitudinal axis of oar 130B at the catch of the drive phase.

Still referring to FIG. 2, in this example, the perpendicular distance Dsx from the rotational axis of pulley 168A to Y-axis 116 is about 67 cm, and the distance Dps from the vertical centerline of set pin 138A to the rotational axis of pulley 168A along a line parallel to the Y-axis is about 135 cm. Regarding a typical stroke, in this example forward catch angle $\phi$ is about 55° and aftward release angle $\alpha$ is about 45°. Also in this particular example, and as seen in FIG. 3, the inboard (i.e., inboard of oarlock 136A) length Lci of central member 140A is about 70 cm, length Loo of oar 130A outboard of oarlock 136A is an adjustable 93 cm and the length Lh of handle 142A extending from central member 140A is about 43 cm. Generally, the distance Dc between connection 176A of tensile member 172A (FIG. 1) of resistance system 126A and oarlock 136A is about 25% to 100% of the overall length of oar 130A inboard of oarlock 136A, which in this example is about 113 cm (70 cm+43 cm). It is also seen that upper surface 154A of water table 122A is located at a height Hw of about 56 cm from a horizontal surface 178 supporting rowing simulator 100, and the vertical pivot axis of oarlock 136A is located at a height Hvpa of 80 cm above the horizontal surface. The horizontal centerline of pulley 168A is located at a distance Dsz of about 5 cm above upper surface 154A of water table 122A. Again, these dimensions are merely illustrative of an embodiment that the present inventor has found to provide a fairly realistic simulation of rowing on water. Other embodiments can be set up differently to achieve similar results. Vertical and horizontal dimensions for other parts of rowing simulator 100, such as height of gunwales 104A-B, location of seats 112A-B width of seat deck 104C, locations of foot stretcher pairs 110A-B, depth of footwells 114A-B and length of travel of the seats, can be readily determined by those skilled in the art, for example, using corresponding respective dimensional information based on an actual rowing boat.

As best seen in FIG. 1, this embodiment of rowing simulator 100 includes a full-stroke gauge 180 that is attached to water table 122A and allows a training coach, the rower in rowing station 106A and/or another viewer to view the performance of the rower while rowing. Full-stroke gauge 180 includes, among other things, a transparent, curved panel 182 fixed to water table 122A and an oar-location indicator 184 fixedly attached to the end of oar 130A proximate the curved panel. The transparency of panel 182 allows a viewer to view the movement of oar-location indicator 184 from a position outboard of water table 122A relative to rowing simulator 100. As described below in connection with FIG. 5, full-stroke gauge 180 includes various markings and other features that assist the viewer and/or rower with judging the rower's performance during various phases of the rower's stroke.

Figure 5:
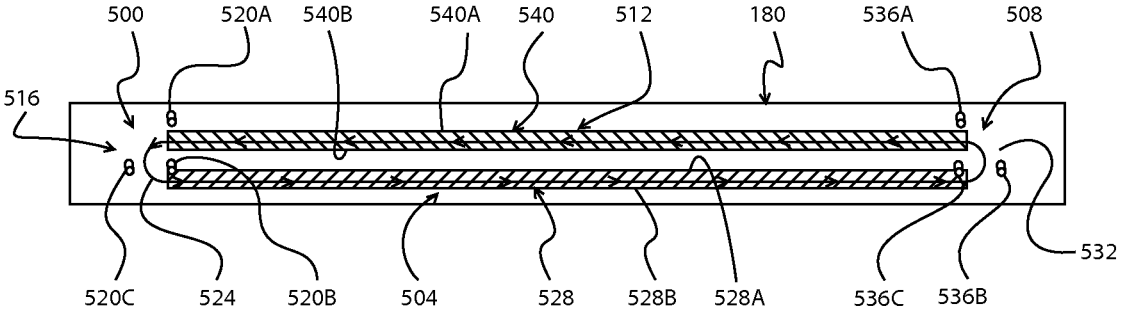
FIG. 5 is an enlarged elevational view of the full-stroke gauge of FIG. 1

Referring now to FIG. 5, and also to FIGS. 1-3 as needed for context, full-stroke gauge 180 includes four gauge zones, specifically, a catch zone 500, a drive zone 504, a finish zone 508 and a recovery zone 512. Each of zones 500, 504, 508, 512 is provided with a corresponding gauge that not only can provide stroke feedback to the rower, but also allows a viewer to visually analyze the rower's performance as a function of the location of oar-location indicator 184 (FIG. 1) at any point within each of the zones.

Catch zone 500 includes a catch gauge 516, which in this example comprises a number of pegs, here three pegs 520A-C, positioned to provide boundaries that define the optimal location and configuration of the catch zone. Pegs 520A-C provide visual information regarding catch zone 500, and they also can provide tactile feedback to the rower if oar-location indicator 184 (FIGS. 1 and 4) strikes any one or more of the pegs during rowing. FIG. 5 illustrates an exemplary stroke path 524 superimposed on full-stroke gauge 180. As those skilled in the art will readily appreciate, stroke path 524 is the trajectory of the tip of oar-location indicator 184 (FIG. 1) during a full stroke cycle. In this example, the stroke that results in stroke path 524 is properly executed in catch zone 500 because it enters the catch zone between pegs 520A and 520B and then exits the catch zone between pegs 520B and 520C where it then enters drive zone 504. As those skilled in the art will appreciate, any stroke path (not shown) that does not fall between the pairs of pegs 520A-C in the manner just indicated is not optimal. Catch gauge 516 may also, or alternatively, include markings and/or translucent color applied to transparent panel 182 that define the proper catch zone 500. In one example, catch gauge 516 includes a translucent colored film (not shown) adhered to transparent panel 182 at catch zone 500.

Drive zone 504 includes a drive gauge 528 that defines the elevational bounds of a proper rowing stroke during the drive phase. In other words, as long as the trajectory of the tip of oar-location indicator 184 (FIG. 1) falls within the upper and lower boundaries 528A, 528B, respectively, such as seen with stroke path 524, the corresponding stroke may be considered acceptable. That said, while the trajectory of the tip of oar-location indicator 184 of a particular drive phase may stay within upper and lower boundaries 528A-B of drive gauge 528, the trajectory may waver upwardly and/or downwardly depending on the actions of the rower. In this case, a trained viewer could see this wavering and work to correct the rower's stroke accordingly. In the present example, drive gauge 528 comprises a region of translucent color, for example a sheet (not shown) of colored film adhered to transparent panel 182.

Like catch zone 500 discussed above, finish zone 508 includes a finish gauge 532, which in this example comprises a number of pegs, here three pegs 536A-C, positioned to provide boundaries that define the optimal location and configuration of the finish zone. Pegs 536A-C provide visual information regarding finish zone 500, and they also can provide tactile feedback to the rower if oar-location indicator 184 (FIG. 1) strikes any one or more of the pegs during rowing. In the example illustrated in FIG. 5, the stroke that results in stroke path 524 is properly executed in finish zone 508 because it enters the catch zone between pegs 536B and 536C and then exits the catch zone between pegs 536A and 536B where it enters recovery zone 512. As those skilled in the art will appreciate, any stroke path that does not fall between the pairs of pegs 536A-C in the manner just indicated is not optimal. Finish gauge 532 may also, or alternatively, include markings and/or translucent color applied to transparent panel 182 that define the proper finish zone 508. In one example, finish gauge 532 includes a translucent colored film (not shown) adhered to transparent panel 182 at finish zone 508.

Recovery zone 512 includes a recovery gauge 540 that defines the elevational bounds of a proper rowing stroke during the recovery phase. In other words, as long as the trajectory of the tip of oar-location indicator 184 (FIG. 1) falls within the upper and lower boundaries 540A, 540B, respectively, such as seen with stroke path 524, the corresponding stroke may be considered acceptable. That said, while the trajectory of the tip of oar-location indicator 184 of a particular recovery phase may stay within upper and lower boundaries 540A-B of recovery gauge 540, the trajectory may waver upwardly and/or downwardly depending on the actions of the rower. In this case, a trained viewer could see this wavering and work to correct the rower's stroke accordingly. In the present example, recovery gauge 540 comprises a region of translucent color, for example a sheet (not shown) of colored film adhered to transparent panel 182.

Referring again to FIG. 1, it can be readily seen that rowing station 106B does not include a panel corresponding to transparent panel 182, but still has a catch gauge 186 and a finish gauge 188 located in corresponding respective catch and finish zones 190, 192, respectively. In this example, catch and finish gauges 186, 188 are similar to catch and finish gauges 516, 532 of full-stroke gauge 180 as illustrated in FIG. 5, except that pegs 186A-C, 188A-C of the corresponding respective catch and finish gauges are mounted to respective peg supports 186D, 188D that, in turn, are affixed to water table 122B. It is noted that during the drive phase of the rowing stroke, indicia 164B on strut 158B of guide follower 132B can be used to gauge a rower's performance as described above. In other embodiments, water table 122B can be fitted with a panel (not shown) that provides drive and recovery gauges, for example, in a manner similar to drive and recovery gauges 528, 540 of FIG. 5.

While the foregoing description of FIGS. 1-5 are directed to a very specific example of a rowing simulator made in accordance with the present disclosure, those skilled in the art will understand that aspects of rowing simulator 100 can be changed without departing from concepts underlying the detailed example provided above. Following are some examples of alternatives for these aspects.

Figure 4:
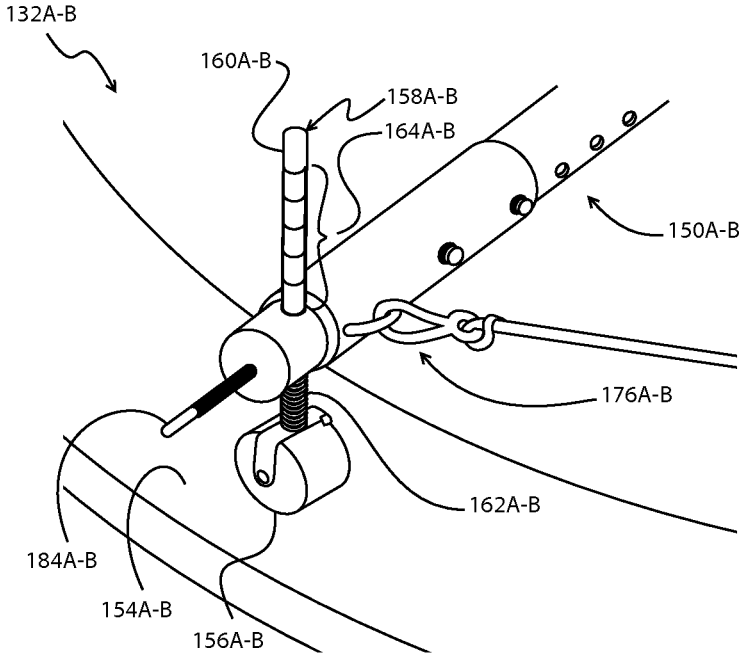
FIG. 4 is a perspective detail view of each of the guide followers of the oar assemblies of FIG. 1.
Figure 6:
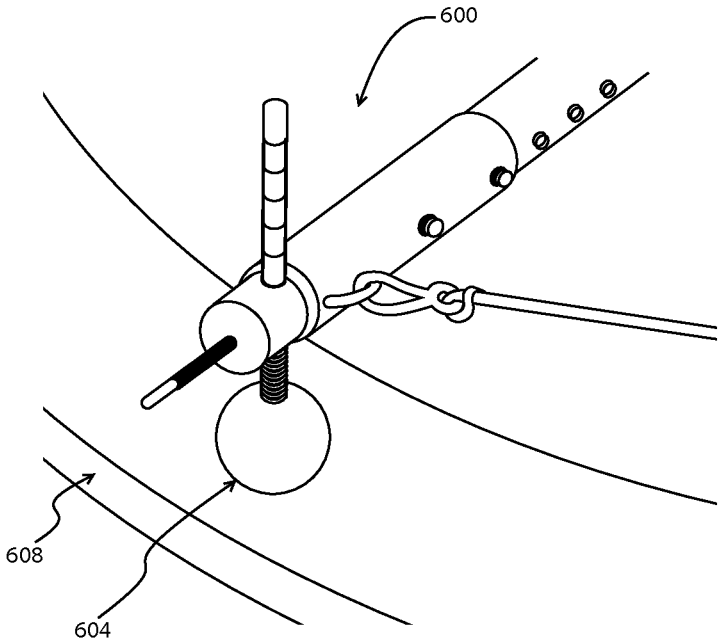
FIG. 6 is a perspective detail view of an alternative guide follower that can be used to replace the guide followers of FIG. 1.

Regarding guide followers 132A-B, the embodiment shown in FIGS. 1 and 4 comprises roller assemblies 150A-B to provide a low-friction interface between oars 130A-B and corresponding respective water tables 122A-B. FIG. 6 illustrates an alternative guide follower 600 that can be used in place of each of roller-based guide followers 132A-B. As seen in FIG. 6, guide follower 600 includes a fixed low-friction element 604 selected to provide a low-friction interface with a corresponding oar guide 608. The material(s) of low-friction element 604 can be selected based on the material of oar guide 608 upon which it will slide. Example materials for low friction element 604 include, among others, nylon, polytetrafluoroethylene, polished metal, etc.

Figure 7:
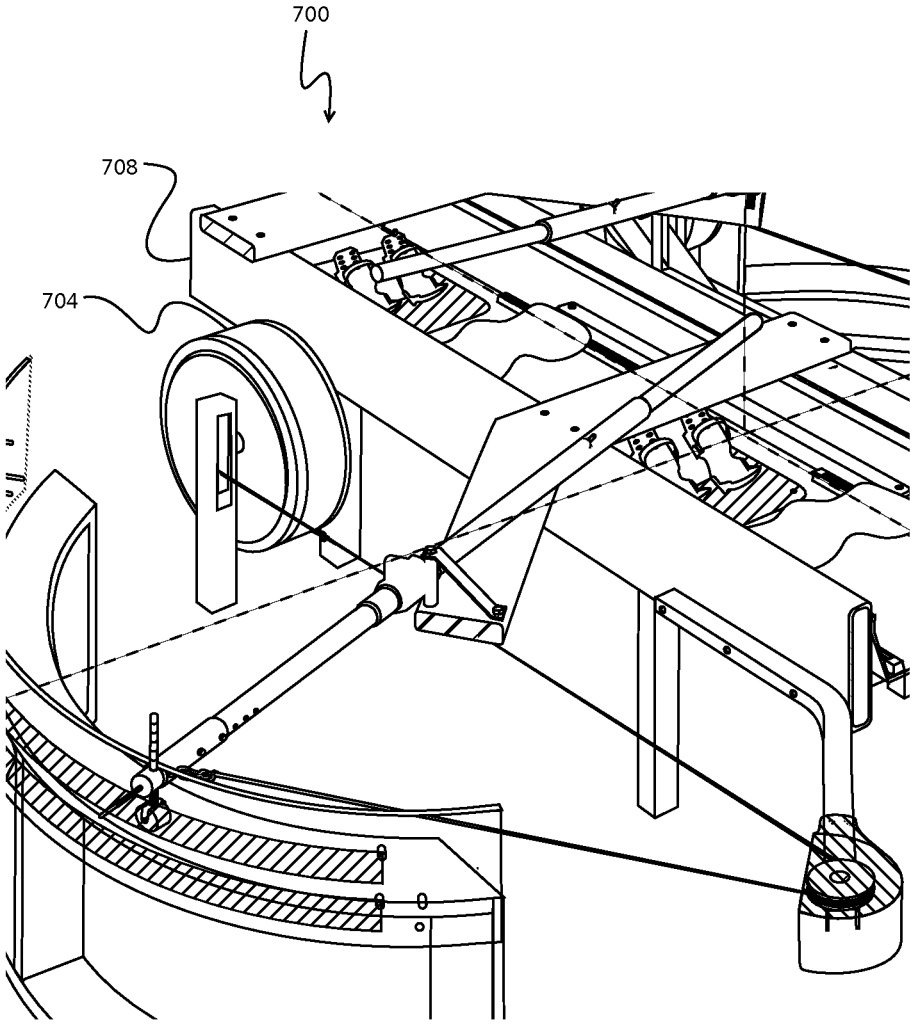
FIG. 7 is a perspective partial view of an alternative rowing simulator having a resistance element attached to the shell structure.
Figure 8:
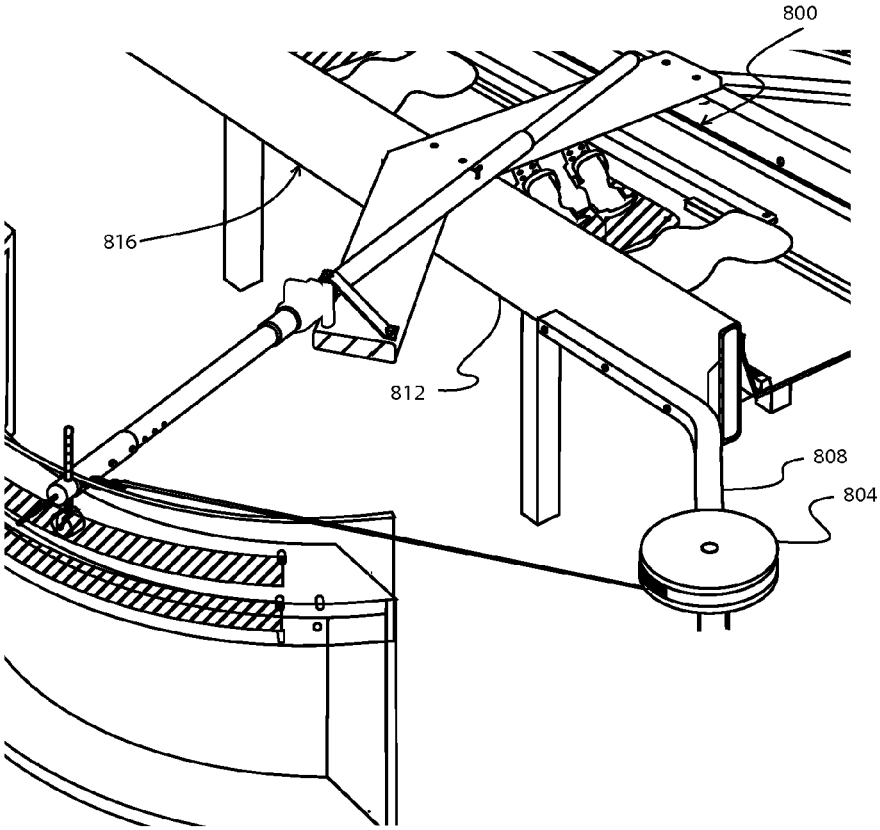
FIG. 8 is a perspective partial view of another rowing simulator having a resistant element attached to an outrigger.

In FIGS. 1-3, resistance devices 166A-B shown are parts of corresponding respective CONCEPT2® rowing machines. However, in other embodiments other resistance devices can be used. For example, FIG. 7 illustrates an alternative rowing simulator 700 having a resistance device 704 attached directly to shell structure 708, which can be the same as or different from shell structure 102 of FIG. 1. FIG. 8 illustrates another rowing simulator 800 that has a resistance device 804 attached to a support brackets 808 that is fixedly attached to the gunwale 812 of a shell structure 816, which can be the same as or different from shell structure 102 of FIG. 1. This example generally replaces pulleys 168A-B, which are not necessary because the design of rowing simulator 800 is not predicated on the use of resistance devices of existing rowing machines, as is the design of rowing simulator 100 of FIG. 1.

Each resistance device 704, 804 can be the same as resistance devices 166A-B of FIG. 1, but they can also be different. Generally, a resistance device, regardless of particular form, that is suitable for use in many embodiments of a rowing simulator of the present disclosure should have a variable resistance of zero pounds to about 300 pounds to about 400 pounds and fairly accurately simulate the force-versus-oar-drive-angle curve derived from actual rowing on water. This will allow the rowing simulator constructed therewith to have a realistic-feeling rowing stroke.

It is noted that the height of shell structure 102 and upper surfaces 154A-B of water tables 122A-B in FIG. 1 are driven in part by the use of existing rowing machines for their resistance devices 166A-B. However, in alternative designs, such as illustrated in FIGS. 7 and 8, the height of the rowing simulator can be higher or lower than depicted in FIG. 1. Indeed, in some embodiments, the shell structure can be made low enough to use, for example, a floor, such as the floor of a gymnasium, or an outdoor surface, such as the surface of a concrete pad, as the oar guide(s). A drawback of such a low design, however, may be that it is uncomfortable for a rowing coach or other viewer to accurately view any stroke gauges provided, especially drive and recovery gauges, due to them being relatively very low to the floor/ground/etc.

Figure 9:
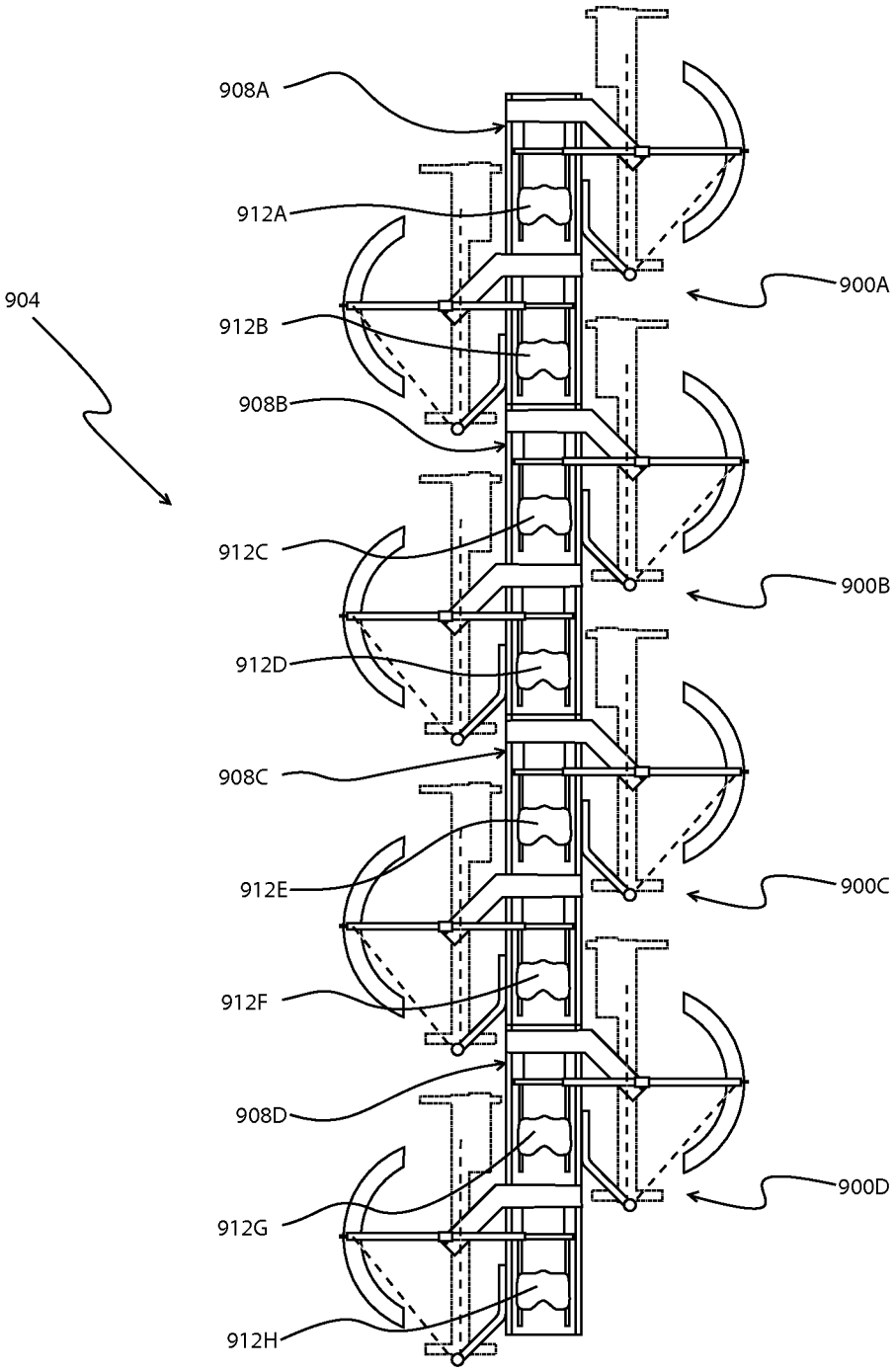
FIG. 9 is a top view of a multi-module rowing simulator made using four modules that are each identical to the rowing simulator of FIG. 1.

Rowing simulator 100 of FIGS. 1-5 can be used alone to accommodate one or two rowers. However, rowing simulator 100 is designed as a module that can be used with other like modules to create a rowing simulator having as many rowing stations as desired. For example, FIG. 9 shows four identical rowing-simulator modules 900A-D linked together to provide a rowing simulator 904 that simulates an eight-rower sweep-rowing boat. In this example, the shell structures 908A-D of adjacent ones of modules 900A-D are mechanically connected to one another, for example, using suitable pins, bolts, etc. In addition, if desired, not only can seats 912A-H within any one or more of modules 900A-D be linked together with a rigid link so that they move in unison with one another, but the seats of adjacent modules can be rigidly linked together, as well. For example, with all eight seats 912A-H linked together, they will all move in unison. As mentioned above, this linking can be beneficial in coordinating the rowing motions of all the rowers aboard rowing simulator 904. It is noted that while each module 900A-D, and therefore entire rowing simulator 904, is set up to simulate a sweep-rowing boat, in alternative embodiments, the modules and the entire rowing simulator can be set up as a skulling boat. Of course, each module 900A-B does not need to be the same as rowing simulator 100 of FIG. 1, but rather it can have an alternative configuration, such as, for example, either of the configurations illustrated in FIGS. 7 and 8. Many other variations that are not shown in any of the attached drawings are possible.

FIG. 10 illustrates another rowing simulator 1000 made in accordance with the present invention. In this embodiment, simulator 1000 is largely the same as rowing simulator 100 of FIGS. 1-3 except as described below. As seen in FIG. 10, the oar guide, here water table 1004, is attached at one end to the shell structure 1008 via an outrigger 1012 and includes several support legs 1016 spaced along its arcuate length. In this example, water table 1004 makes efficient use of material by being relatively narrow in width along its arcuate length, which mimics the arcuate trajectory of the guide follower, here a wheel 1020 rotatably attached to an oar 1024 so as to be rotatable about the longitudinal central axis 1028 of the oar. As those skilled in the art will readily appreciate, wheel 1020 can be rotatably mounted to oar 1024 via a suitable low-friction rotational bearing, such as a ball-bearing assembly 1032.

In this example, a catch gauge 1036 and a finish gauge 1040 are each moveably secured to water table 1004 so as to be readily located on the water table to suit the rowing stroke of a particular rower and/or the particular set up of rowing simulator 1000, including the length of oar 1024 and the relative location of the oar support 1044. Catch and finish gauges 1036, 1040 can be movable secured to water table 1004 in any suitable manner, such as by magnetic attraction, using a peg and hole connection (e.g., holes (not shown) along the outer circumference 1004A of tabletop 1004B and mating pegs on the gauges), via releasable clamps or other removable fasteners, via hook and loop fasteners, etc. Each of catch and finish gauges 1036, 1040 of this embodiment is simple, comprising a base 1036A, 1040A and a corresponding pair of markers 1036B(1), 1036B(2), 1040B(1), 1040B(2). Correspondingly, an oar-end-position indicator 1048 is attached to end of oar 1024, here in a manner such that it extends along longitudinal central axis 1028 of the oar. As those skilled in the art will appreciate, the respective pairs of markers 1036B(1), 1036B(2), 1040B(1), 1040B(2) define a catch zone 1036C and a finish zone 1040C in which the rower (not shown) should keep oar-end-position indicator 1048 during the catch and finish maneuvers of the rowing stroke, respectively.

As can be readily envisioned, during a proper rowing stroke, the rower moves oar 1024 during the drive phase so that wheel 1020 rolls on water table 1004 so that oar-end-position indicator 1048 passes under marker 1040B(1) on finish gauge 1040. At an appropriate point after oar-end-position indicator 1048 has passed under marker 1040B(1), the rower moves oar 1024 so that the oar-end-position indicator moves upward between markers 1040B(1) and 1040B(2) within finish zone 1040C to execute the finish maneuver. Similar, at the end of the recovery phase, the rower moves oar 1024 so that oar-end-position indicator 1048 passes over marker 1036(B)1 and then moves downward between markers 1036B(1) and 1036B(2) within catch zone 1036C so as to execute the catch maneuver. Water table 1004 includes an oar stop 1050 against which oar 1024 rests when the oar is not in use in order to keep the oar within the reasonable grasp of the rower before the rower starts rowing.

Rowing simulator 1000 also includes a resistance system 1052 that is largely the same as each resistance system 126A-B of rowing simulator 100 of FIGS. 1-3, except that system 1052 of FIG. 10 includes a pair of pulleys 1056, 1060. Pulley 1056 is located so that the cable 1064 exits resistance device 1068 (such as, e.g., the resistance erg of a CONCEPT2® rowing machine) at the proper horizontal angle, and pulley 1060 is located relative to pulley 1056 and the connection point 1072 of the cable to oar 1024 so as to provide the rower (not shown) with resistance during the drive phase of the rowing stroke that emulates that resistance the rower would feel during actual on-water rowing. In the embodiment shown, pulley 1060 is located outboard of pulley 1056 and slightly forward of pulley 1056. The present inventor has found that this location of pulley 1060, when used in conjunction with a current generation CONCEPT2® rowing machine as resistance device 1068 and with connection point 1072 shown, can provide a more realistic feel than if pulley 1056 were used alone. It is noted that pulley 1060 can provided in a way that its location is adjustable. For example, in the embodiment shown in which pulley 1060 is mounted to a bracket 1076 that also is connected to pulley 1056, pulley 1060 can be secured to this bracket so as to be movable longitudinally relative to the central axis 1080 of the bracket and the bracket can be pivotable about the rotational axis 1084 of pulley 1056, so that pulley 1060 is locatable in a polar coordinate fashion. That said, pulley 1060 can be relocatable in other fashions, such as providing a set of holes (not shown) in water table 1004 between oar stop 1050 and pulley 1056 through which a fastener (not shown) that is concentric with the axle 1088 of pulley 1060 can extend. Those skilled in the art will recognize how to adjust the location of a pulley of another rowing simulator that corresponds to pulley 1060 according to the particular arrangement and instrumentalities of that rowing simulator.

Figure 11:
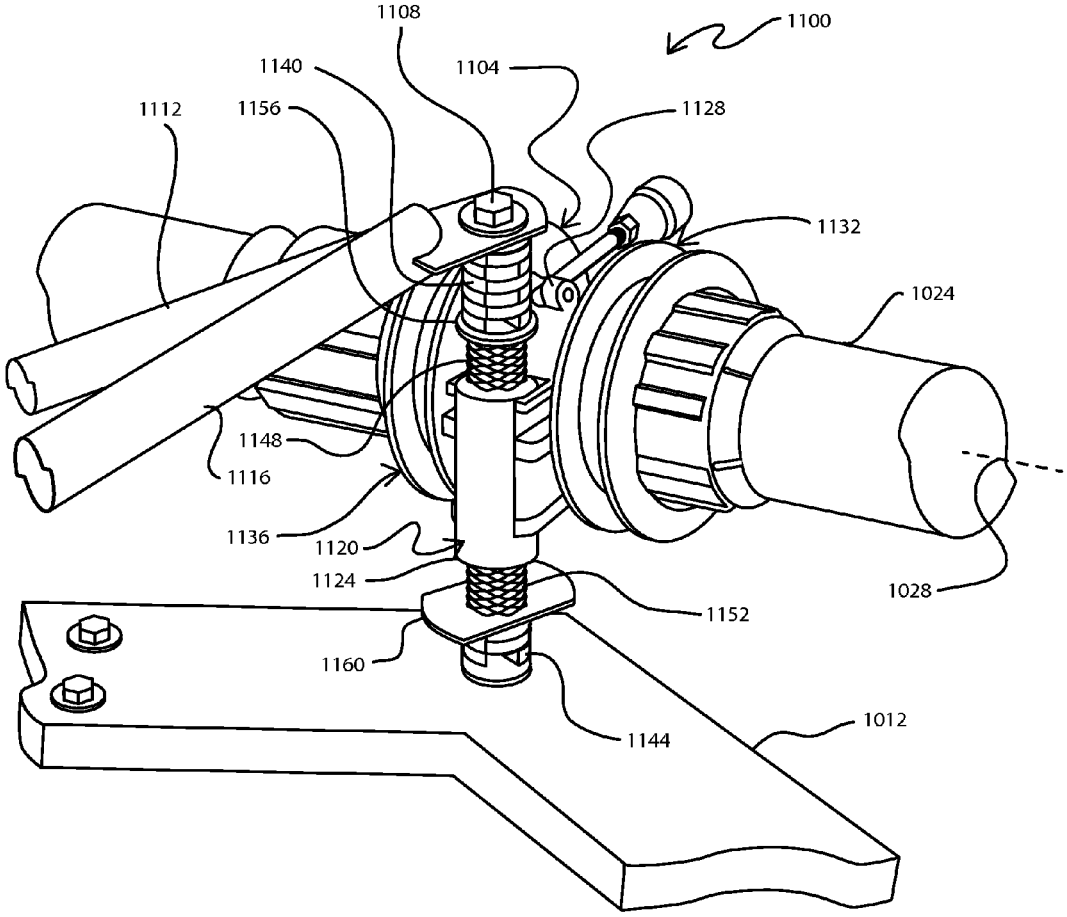
FIG. 11 is an enlarged perspective view of an oar support having a built-in vertical-feel emulator.

FIG. 11 illustrates an oar support 1100 that includes a vertical-feel emulator 1104. Oar support 1100 can be used with any suitable rowing simulator, such as simulator 1000 of FIG. 10. Indeed, oar support 1100 is described in the context of simulator 1000. As will be understood by those skilled in the art, vertical-feel emulator, in conjunction with an oar guide (here, water table 1004 of FIG. 10) and corresponding guide follower (here, wheel 1020 of FIG. 10), provides increasing vertical resistance to a rower as they lifts up on the oar handle 1028A (FIG. 10; located to the right relative to FIG. 11) during the catch and drive phases of the stroke to simulate the sensation and resistance, or "vertical feel," that the rower would experience during actual rowing on water.

With continuing reference to FIG. 11, and also to FIG. 10, in the embodiment shown, oar support 1100 includes a vertical pivot pin 1108 fixedly supported at the top by a pair of stays 1112, 1116 (see also FIG. 10) and at the bottom by outrigger 1012 (see also FIG. 10). Oar 1024 is movably engaged with pivot pin 1108 via an oar-lock assembly 1120 that includes a vertical sleeve 1124 and an oar lock 1128 used to lock the oar to the vertical sleeve. Sleeve 1124 is sized so as to be freely movable vertically along pivot pin 1108 and rotationally about the pivot pin. Oar 1024 includes inboard and outboard collar assemblies 1132, 1136, respectively, for stabilizing the oar relative to pivot pin 1108 along longitudinal central axis 1028 of the oar.

In this example, vertical-feel emulator 1104 includes an upper spring 1140 and a lower spring 1144 that provide, respectively, resistance to vertical travel of sleeve 1124, and hence oar 1024, in both upward and downward directions. Due to the length of pivot pin 1108, the length of sleeve 1124, and the lengths of upper and lower springs 1140, 1144, in this embodiment oar support 1100 also includes a pair of spacers 1148, 1152 and a pair of washers 1156, 1160. As can be readily envisioned by those skilled in the art, when the rower finishes the recovery phase of the rowing stroke and executes the catch maneuver, the rower lifts the oar handle so as to engage wheel 1020 (FIG. 10) with water table 1004. As the rower continues to lift during the catch maneuver the pivoting of oar 1024 about wheel 1020 causes sleeve 1124 (FIG. 11) to move upward and encounter the resistance of upper spring 1140 as the upper spring is compressed. This movement and resistance give the rower a sensation and resistance that mimics the sensation and resistance that the rower would feel during the catch maneuver of actual on-water rowing. As the rower continues with the stroke with the drive phase, the resistance of upper spring 1140 continues to provide the rower with a realistic feel emulating the feel of the paddle of an actual oar in water. Those skilled in the art will readily appreciate that other configurations of a vertical-feel emulating oar support that achieve the same or similar result as oar support 1100 are possible. For example, helical-type springs 1140, 1144 can be replaced with other types of springs, such as cylindrical rubber springs, among others. In addition, those skilled in the art will be able to select the proper spring constants to achieve the desired feel.

FIG. 12 illustrates how the inventions and features disclosed herein can be readily incorporated into a sculling-type rowing simulator 1200. Referring to FIG. 12, rowing simulator 1200 in this example is configured as a two-rowing-station simulator having first and second rowing stations 1204, 1208. Being a sculling-type simulator, each rowing station 1204, 1208 includes a pair of oars 1212A-B, 1216A-B set up for sculling as shown, with each oar being configured like oar 1024 of simulator 1000 of FIG. 10. Correspondingly, simulator 1200 of FIG. 12 includes suitable oar guides, here four arcuate-shaped water tables 1220A-B, 1224A-B. In this example, each water table 1220A-B, 1224A-B is configured like water table 1004 of simulator 1000 of FIG. 10. It is noted, for the sake of brevity, that other aspects and features of rowing simulator 1200 of FIG. 12 not explicitly described here can be identical to the corresponding aspects and features of rowing simulator 1000 of FIG. 10. Indeed, those skilled in the art comparing FIGS. 10 and 12 will readily see that virtually the only differences between simulator 1200 of FIG. 12 and simulator 1000 of FIG. 10 is that simulator 1200 is configured as a sculling simulator while simulator 1000 is configured as a sweep simulator. It is noted that a sculling simulator made in accordance with the present disclosure could alternatively, for example, have some or all of the features of simulator 100 of FIG. 1, including a mix of features as between simulator 100 of FIG. 1 and simulator 1000 of FIG. 10, and/or could have any one or more other features not specifically shown or described herein but nonetheless falling within the scope of the claims appended hereto.

FIG. 13 shows yet another rowing simulator 1300 made in accordance with the present disclosure. For brevity and convenience, in this example simulator 1300 is identical to rowing simulator 1000 of FIG. 10, except that resistance system 1304 of FIG. 13 is set up differently from resistance system 1052 of FIG. 10. Specifically, resistance system 1304 of FIG. 13 has a pulley arrangement that multiplies the resistance that a rower would feel during the drive phase of the rowing stroke relative to resistance system 1052 of FIG. 10. As seen in FIG. 10, cable 1064 from resistance device 1068 is attached to oar 1024 at connection point 1072 such that the horizontal resistance experienced by the rower during the drive phase of the rowing stroke is a function of the tension in the cable and the horizontal angle that the cable makes with the longitudinal axis of the oar.

However, in resistance system 1304 of FIG. 13, a pulley 1308 is attached to oar 1312 so that the horizontal resistance experienced by the rower of rowing simulator 1300 during the drive phase of the rowing stroke is a function of twice the tension in cable 1320 and the angles θ1, θ2 formed by the two segments 1320A-B of cable 1320 extending from pulley 1308 relative to the longitudinal axis 1316 of the oar. As those skill in the art will readily appreciate, with two segments 1320A-B of cable 1320 contributing to the resistance and the attachment location of pulley 1308 being virtually identical to the location of connection point 1072 of cable 1064 of FIG. 10, the resistance provided by resistance system 1304 of FIG. 13 can be up to twice the resistance of resistance system 1052 of FIG. 10, which has only a single segment of cable 1064 providing the resistance. In the example of FIG. 13, pulley 1324 is identical to pulley 1056 of FIG. 10, a third pulley 1328 is provided along outrigger 1332, and end 1320C of cable 1320 is secured to the outrigger at attachment point 1336.

As those skilled in the art will appreciate, pulleys 1308 and 1328 can be located to optimize the resistance felt by a rower. Those skilled in the art will also appreciate that pulley 1328 can be replaced by a fixed attachment point (not shown) for end 1320C of cable 1320. In alternative embodiments, outrigger 1332 can be provided with multiple such fixed attachment points spaced along the length of the outrigger to allow ready adjustment of the resistance. Likewise, outrigger 1332 can be configured to allow pulley 1328 to be located at any of multiple locations along the length of the outrigger. Those skilled in the art will further appreciate that cable 1320 can be looped one or more additional times to further increase the resistance experienced by a rower. For example, with the configuration shown, cable segment 1320B could be moved to the other side of pulley 1328 and cable segment 1320D passed around pulley 1328 and end 1320C attached to oar 1312. In this manner, the resistance would be a function of three times the tension in cable 1320 and the angles θ1, θ2 formed by cable segments 1320A-B, as well as the location of the attachment point (not shown) of cable end 1320C and the angle (not shown) formed between cable segment 1320D and longitudinal axis 1316 of oar 1312. Those skilled in the art will understand that the adjustments available using multiple pulleys, at least one of which is attached to oar 1312, are numerous.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. An apparatus designed and configured to train a rower on a rowing stroke that includes a catch phase, a drive phase, a finish phase, and a recovery phase, the apparatus supported by a first surface and comprising:

a first rowing station that includes:

an oar support having an inboard side and an outboard side relative to the rower;

an oar guide including a guide surface, said guide surface located on said outboard side of said oar support and elevated relative to the first surface;

an oar movably supported by said oar support and including:

an inboard end located on said inboard side of said oar support;

a handle located at said inboard end and being designed and configured to be grasped by the rower while rowing;

an outboard end located on said outboard side of said oar support; and a guide follower designed and configured to contact said oar guide surface during the entirety of the drive phase of the rowing stroke so as to provide substantially no horizontal resistance to movement of said oar by the rower during the drive phase of the rowing stroke; and a resistance mechanism coupled to said oar and designed and configured to resist substantially horizontal movement of said oar by the rower during the drive phase of the rowing stroke.

2. An apparatus according to claim 1, wherein said guide follower includes a roller for rollingly engaging said guide surface during the drive phase of the rowing stroke.

3. An apparatus according to claim 1, wherein said guide follower includes a slider for slidingly engaging said guide surface during the drive phase of the rowing stroke.

4. An apparatus according to claim 1, wherein said guide follower is springingly coupled to said oar at said outboard end so as to provide increasing resistance to vertical pivoting of said oar as the rower pulls upward on the handle while said guide follower is engaged with said guide surface.

5. An apparatus according to claim 4, further comprising a spring coupling said guide follower to said oar, wherein said spring is selected to mimic the interaction of a water-rowing oar with water during waterborne rowing.

6. An apparatus according to claim 4, further comprising a depth gauge designed and configured to provide a visual indication of the extent of vertical pivoting of said oar as the rower pulls upward on the handle while said guide follower is engaged with said guide surface.

7. An apparatus according to claim 1, wherein said guide follower is fixedly coupled to said oar and said oar is springingly coupled to said oar support so as to provide increasing resistance to vertical pivoting of said oar as the rower pulls upward on the handle while said guide follower is engaged with said guide surface.

8. An apparatus according to claim 7, further comprising a spring coupling said oar to said oar support, wherein said spring is selected to simulate the interaction of a water-rowing oar with water during waterborne rowing.

9. An apparatus according to claim 7, further comprising a depth gauge designed and configured to provide a visual indication of the extent of vertical pivoting of said oar as the rower pulls upward on the handle while said guide follower is engaged with said guide surface.

10. An apparatus according to claim 1, further comprising a catch gauge and a finish gauge spaced from one another along an arcuate path swept by said outboard end of said oar during portions of the rowing stroke.

11. An apparatus according to claim 1, further comprising an oar-location indicator secured to said oar at said outboard end of said oar.

12. An apparatus according to claim 1, further comprising a recovery gauge designed and configured to provide visual feedback on position of said oar during the recovery phase of the rowing stroke.

13. An apparatus according to claim 12, wherein said recovery gauge includes an arcuate panel extending alongside an arcuate path swept by said outboard end of said oar during the recovery phase of the rowing stroke.

14. An apparatus according to claim 13, wherein said arcuate panel comprises a translucent material.

15. An apparatus according to claim 12, further comprising an oar-location indicator secured to said oar at said outboard end of said oar, said oar-location indicator designed and configured to work in conjunction with said recovery gauge to provide visual feedback of the trajectory of said oar during the rowing stroke.

16. An apparatus according to claim 12, further comprising a drive gauge designed and configured to provide visual feedback on position of said oar during the recovery phase of the rowing stroke.

17. An apparatus according to claim 16, wherein said drive gauge includes an arcuate panel extending alongside said guide surface.

18. An apparatus according to claim 17, wherein said arcuate panel comprises a translucent material.

19. An apparatus according to claim 17, further comprising an oar-location indicator secured to said oar at said outboard end of said oar, said oar-location indicator designed and configured to work in conjunction with said recovery gauge to provide the rower with visual feedback of the trajectory of said oar during the rowing stroke.

20. An apparatus according to claim 1, further comprising a catch gauge designed and configured to provide visual information on the movement of said oar by the rower during at least a portion of the catch phase of the rowing stroke.

21. An apparatus according to claim 20, wherein said catch gauge includes fore and aft markers delimiting fore and aft limits of an acceptable catch zone.

22. An apparatus according to claim 1, further comprising a finish gauge designed and configured to provide visual information on the movement of said oar by the rower during at least a portion of the finish phase of the rowing stroke.

23. An apparatus according to claim 22, wherein said finish gauge includes fore and aft markers delimiting fore and aft limits of an acceptable finish zone.

24. An apparatus according to claim 1, further comprising a recovery gauge designed and configured to provide visual information on the movement of said oar by the rower during the recovery phase of the rowing stroke.

25. An apparatus according to claim 1, further comprising a drive gauge designed and configured to provide visual information on the movement of said oar by the rower during the drive phase of the rowing stroke.

26. An apparatus according to claim 1, further comprising a full-stroke gauge designed and configured to provide visual information on the movement of said oar during all phases of the rowing stroke.

27. An apparatus according to claim 26, wherein said full-stroke gauge includes a catch gauge, a finish gauge spaced from said catch gauge, and a recovery gauge extending between said catch and finish gauges.

28. An apparatus according to claim 27, wherein said full-stroke gauge further includes a drive gauge extending between said catch and finish gauges.

29. An apparatus according to claim 27, wherein:

said outboard end of said oar sweeps out an arcuate trajectory during each of the drive and recovery phases; and said full-stroke gauge includes a panel curved to conform to the arcuate trajectories of the drive and recovery phases.

30. An apparatus according to claim 27, wherein said panel includes translucent indicia demarcating an acceptable recovery region.

31. An apparatus according to claim 1, wherein the rowing stroke further includes blade-feathering, and the apparatus further includes a feathering gauge designed and configured to provide an indication of the blade feathering.

32. An apparatus according to claim 31, wherein said oar has a longitudinal axis and said handle is pivotable about said longitudinal axis, said feathering gauge including an indicator that pivots in concert with said handle.

33. An apparatus according to claim 1, further comprising a second rowing station located forward of said first rowing station, wherein:

said first rowing station has a first seat movable forward and aftward during the rowing stroke;

said second rowing station has a second seat movable forward and aftward during the rowing stroke; and said first and second seats are fixedly coupled to one another so as to move in unison during the rowing stroke.

34. An apparatus according to claim 1, wherein said first rowing station is contained in a first module and includes a first seat movable forward and aftward during the rowing stroke, said apparatus further comprising a second module containing a second rowing station having a second seat, wherein said first and second seats are fixedly coupled to one another so as to move in unison during the rowing stroke.

35. An apparatus according to claim 1, wherein said resistance mechanism located aftward of said oar support, the apparatus further comprising:

a flexible elongate member connecting said resistance mechanism to said oar at a location on said oar outboard of said oar support; and a first pulley located forward of said oar support, said flexible elongate member is engaged with said first pulley.

36. An apparatus according to claim 1, wherein said first rowing station is configured as a sweep station.

* * * * *